US006761496B2

(12) United States Patent
Osada et al.

(10) Patent No.: US 6,761,496 B2
(45) Date of Patent: Jul. 13, 2004

(54) WRITING UTENSIL

(75) Inventors: Takahiro Osada, Gunma (JP); Kazuhiro Ami, Gunma (JP); Yukinori Sawa, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 49 days.

(21) Appl. No.: 10/297,200

(22) PCT Filed: Jun. 14, 2001

(86) PCT No.: PCT/JP01/05075

§ 371 (c)(1),
(2), (4) Date: Dec. 4, 2002

(87) PCT Pub. No.: WO01/96126

PCT Pub. Date: Dec. 20, 2001

(65) Prior Publication Data

US 2003/0143017 A1 Jul. 31, 2003

(30) Foreign Application Priority Data

Jun. 16, 2000 (JP) ..... 2000-181987

(51) Int. Cl.[7] ..... B43K 5/00; B43K 8/08
(52) U.S. Cl. ..... 401/199
(58) Field of Search ..... 401/199, 198, 401/196

(56) References Cited

U.S. PATENT DOCUMENTS

| | | | | |
|---|---|---|---|---|
| 5,066,329 A | * | 11/1991 | Schmickl et al. | 106/31.58 |
| 5,961,703 A | * | 10/1999 | Fraas | 106/31.29 |
| 6,004,388 A | * | 12/1999 | Osada | 106/31.57 |
| 6,474,893 B1 | * | 11/2002 | Osada et al. | 401/198 |

FOREIGN PATENT DOCUMENTS

| | | | |
|---|---|---|---|
| GB | 2314852 A | * | 1/1998 |
| JP | 54-19826 A | | 2/1979 |
| JP | 55-090569 A | | 7/1980 |
| JP | 56-112980 | | 9/1981 |
| JP | 58-112980 | | 9/1981 |
| JP | 172133/1981 | | 5/1983 |
| JP | 58-108270 | | 6/1983 |
| JP | 01-263173 | | 10/1989 |
| JP | 01-281999 | | 11/1989 |
| JP | 02-232277 A | | 9/1990 |
| JP | 03-097774 A | | 4/1991 |
| JP | 3-95288 U | | 9/1991 |
| JP | 7-242094 A | | 9/1995 |
| JP | 10-060355 A | | 3/1998 |
| JP | 10-081094 A | | 3/1998 |
| JP | 10-081095 A | | 3/1998 |
| JP | 10-140071 A | | 5/1998 |
| WO | WO 00/37265 A1 | | 6/2000 |

* cited by examiner

*Primary Examiner*—Gregory L. Huson
*Assistant Examiner*—Huyen Le
(74) *Attorney, Agent, or Firm*—Burns, Doane, Swecker & Mathis, L.L.P.

(57) ABSTRACT

A writing instrument equipped with an exchangeable inner pen filled with an ink containing a solvent having a vapor pressure of 1 to 50 mm Hg (20° C.) in a writing instrument main body which is a barrel part, wherein the inner pen described above has a pen tip comprising a fiber feeder or a plastic feeder, and the above pen tip is coated with a substance having a vaporization-inhibiting action in an amount of 0.01 to 20% by weight in terms of a weight ratio based on the pen tip. It is more effective to further add a substance having a vaporization-inhibiting action to the ink. The substance having a vaporization-inhibiting action includes glycerin derivatives, polyoxyethylenesorbit fatty acid esters, alkyl phosphates, waxes and lecithin.

20 Claims, 5 Drawing Sheets

WRITING UTENSIL

TECHNICAL FIELD

The present invention relates to a writing instrument having a structure in which inhibition of vaporization of an ink solvent is incomplete, which is equipped with an exchangeable inner pen (refill) filled with an ink which has a pen tip comprising a fiber feeder or a plastic feeder, particularly to a writing instrument suited to a marking pen, a white board marker and a felt-tip pen.

BACKGROUND ART

A large variety of writing instruments of a refill type has so far been put to practical use for ballpoint pens. In ballpoint pens, inks contain solvents having a low vapor pressure and have a high viscosity, and therefore the inks are less liable to volatilize. Further, the ballpoint pens have a structure in which a refill is less degraded and the refill can be exchanged.

In contrast with this, in markers called marking pens as a common name in which a pen tip comprises a fiber feeder comprising a fiber bundle or a plastic feeder, the following problem is present when markers of a refill type are put to practical use (actualize).

That is, as a principle, use of a solvent having a low vapor pressure (less liable to volatize) makes it possible to actualize marking pens of a refill type requiring no cap or having a structure in which a refill is incompletely sealed, but they have the problem that a drawn line-drying property which is a characteristic of a marking pen is damaged, so that the drawn lines are less liable to be dried.

When a solvent having a high vapor pressure (liable to volatize) is used, the drawn line-drying property is good, but if a writing instrument main body (external structure) in which a refill is mounted is not provided with a structure for sufficiently inhibiting a solvent from vaporizing, generated is a problem that a viscosity of an ink (particularly, a surface and an inside of a pen feeder) is elevated due to volatilization of the solvent, which makes writing impossible.

Known as a writing instrument in which a writing instrument main body is provided with a structure for preventing a solvent from vaporizing are, for example, a knock type writing instrument 44 as shown in FIGS. 4(*a*) and (*b*), in which a cap part 42 for a housing room 41 for housing a pen tip 40 covers the room when the pen tip is drawn in by a string member 43 to be movable with knocking operation (U.S. Pat. No. 2,579,188, Japanese Patent Application Laid-Open No. 81094/1998, Japanese Patent Application Laid-Open No. 81095/1998 and Japanese Patent Application Laid-Open No. 242094/1995), a knock type writing instrument 49 as shown in FIGS. 5(*a*) and (*b*), in which a housing room 48 for preventing a pen tip 46 from drying is provided in a writing instrument main body 45 which is covered by a rubber member 47 having a slit 47*a* (Japanese Utility Model Application Laid-Open No. 95288/1991) and a knock type writing instrument 54 as shown in FIGS. 6(*a*) and (*b*), in which a sealing member 53 having a slit 53*a* for preventing a pen tip 52 from drying is provided in a front barrel 51 of a writing instrument main body 50 (Japanese Utility Model Application Laid-Open No. 76778/1983). It is considered that writing instruments provided with sealing structures having these dry-preventing mechanisms can solve the problems described above, but if they are provided with both of a sealing structure and a structure which enables refilling, the structure is complicated more and more, and the product becomes more expensive. In addition thereto, it becomes more difficult to secure the sealing property. Further, a problem resides in that a simple structure using an elastic body shown in FIGS. 5 and 6 not only makes the initial performance imperfect but also makes it impossible to secure sufficient sealing due to deterioration of the elastic body with passage of time to cause inferior writing.

On the other hand, the followings have so far been carried out in order to obtain writing instruments such as marking pens, felt-tip pens and writing brush pens which are excellent in a cap-off performance for inhibiting pen tips from drying; that is, higher fatty acid esters of polyglycerin are added to inks (Japanese Patent Publication No. 34352/1987); paraffin waxes which can be deposited on the surface of a pen tip to form a thin film are added to inks (Japanese Patent Publication No. 35028/1989); hexaglyceryl tristearate is added to inks (Japanese Patent Application Laid-Open No. 232277/1990); and lecithin is added to inks (U.S. Pat. No. 2,594,457).

However, additives having a high vaporization-inhibiting effect have a low solubility (10% by weight or less) in solvents in many cases, and a problem resides in the fact that the solubility is low, particularly that the solubility at 0° C. is very low (5% by weight or less). Involved therein is the problem that depositions of the additives described above are produced in the inks during storing at a low temperature or in repeating of low and high temperatures to cause clogging in the ink passages, whereby the writing property is reduced or the cap-off performance is deteriorated with the passage of time, and thus the effective vaporization-inhibiting effect has not yet been obtained.

On the other hand, disclosed in Japanese Patent Application Laid-Open No. 242094/1995 is a method of preventing drying for a writing instrument characterized by that in order to effectively inhibit vaporization of an ink solvent from a writing part during a period passing until initial writing after producing a writing instrument and to prevent it in a state not to be used over a long period of time from producing a cause of inferior writing, a high boiling solvent such as benzyl alcohol having a low volatilizing velocity out of ink solvents is in advance coated on or impregnated into the writing part of the writing feeder described below in a writing instrument in which one end part of a writing feeder prepared from a porous feeder material is inserted into an ink reservoir occuluding an ink prepared by dissolving a dye in a solvent and in which the other end part forms a writing part.

However, in the method of preventing drying for a writing instrument disclosed in this official gazette, an object thereof is to prevent drying during a period passing until initial writing after producing a writing instrument, and used is a high boiling solvent such as benzyl alcohol having a low volatilizing velocity out of ink solvents. Accordingly, it is not intended to prevent the writing part from drying after writing.

That is, a problem resides in that benzyl alcohol is liquid at room temperature and arbitrarily miscible with solvents so that it is occluded into an ink reservoir by virtue of diffusion of the solution to almost lose effect, if the pens are left standing over a long period of time. Further, benzyl alcohol flows out in writing once and therefore does not maintain the effect until the ink is exhausted.

As described above, the current situation is that in writing instruments such as marking pens, felt-tip pens and writing brush pens having pen tips comprising conventional fiber feeders or plastic feeders, the pen tips have not yet been sufficiently inhibited from drying, and the circumstance is that markers such as marking pens of a refill type have not been able to be provided as yet.

In light of the problems on the conventional techniques described above, the present invention intends to solve them, and an object thereof is to provide a writing instrument equipped with an exchangeable inner pen (refill) filled with an ink which has a pen tip comprising a fiber feeder or a plastic feeder, wherein it is excellent in inhibition of vaporization of an ink solvent from a pen tip; even if the writing instrument main body has a structure in which inhibition of vaporization of the ink solvent is insufficient or particularly the writing instrument does not have a cap member, the inner pen (refill) is less deteriorated and exchangeable; and it well adapts to an environmental issues such as the best utilization of the resources and can achieve a reduction in the cost.

DISCLOSURE OF THE INVENTION

Intensive investigations of the problems on the conventional techniques described above repeated by the present inventors have resulted in finding that in order to achieve a writing instrument such as a marking pen, a felt-tip pen and a writing brush pen which is excellent in inhibition of vaporization of an ink solvent from a pen tip and which is equipped with an exchangeable inner pen (refill) filled with an ink which has a pen tip comprising a fiber feeder or a plastic feeder and has a structure in which inhibition of vaporization of an ink solvent is incomplete, effective is coating the pen tip comprising a fiber feeder or a plastic feeder with a substance which is less liable to be dissolved in a solvent and has a vaporization-inhibiting action. Thus, the present invention has come to be completed.

That is, the writing instrument of the present invention having an excellent vaporization-inhibiting performance comprises the following items (1) to (6). (1) A writing instrument equipped with an exchangeable inner pen filled with an ink containing a solvent having a vapor pressure of 1 to 50 mm Hg (20° C.) in a writing instrument main body which is a barrel part, wherein the inner pen described above has a pen tip comprising a fiber feeder or a plastic feeder, and the above pen tip is coated with a substance having a vaporization-inhibiting action, which forms a film that is always regenerated and broken in writing.

(2) The writing instrument as described in the above item (1), wherein the ink further comprises a substance having a vaporization-inhibiting action.

(3) The writing instrument as described in the above item (1) or (2), wherein the substance having a vaporization-inhibiting action is solid at room temperature and has a solubility of 10% by weight or less in an organic solvent at room temperature.

(4) The writing instrument as described in the above item (3), wherein the substance having a vaporization-inhibiting action has a melting point of 40 to 95° C.

(5) The writing instrument as described in the above item (3), wherein the substance having a vaporization-inhibiting action is at least one selected from the group consisting of glycerin derivatives, alkyl phosphates, polyoxyethylenesorbitan fatty acid esters, polyoxyethylenesorbit fatty acid esters, paraffin waxes, microcrystalline waxes, polyolefin waxes and lecithin.

(6) The writing instrument as described in any of the above items (1) to (5), wherein a coating amount of the substance having a vaporization-inhibiting action is 0.01 to 20% by weight in terms of a weight ratio based on the pen tip.

(7) The writing instrument as described in any of the above items (1) to (6), wherein a content of the substance having a vaporization-inhibiting action is 0.01 to 10% by weight based on the total ink amount.

(8) The writing instrument as described in any of the above items (1) to (7), wherein the writing instrument comprises a knock type writing instrument needing no cap member, and operation of a knock part allows the pen tip comprising a fiber feeder or a plastic feeder in the inner pen to go forward from and backward into the writing instrument main body.

BEST MODE FOR CARRYING OUT THE INVENTION

The embodiment of the present invention shall be explained below in details.

The writing instrument of the present invention is a writing instrument having a structure in which inhibition of vaporization of an ink solvent is incomplete, which is equipped with an exchangeable inner pen filled with an ink comprising a solvent having a vapor pressure of 1 to 50 mm Hg (20° C.) in a writing instrument main body which is a barrel part, wherein the inner pen described above has a pen tip comprising a fiber feeder or a plastic feeder, and the above pen tip is coated with a substance having a vaporization-inhibiting action.

Figure 1:
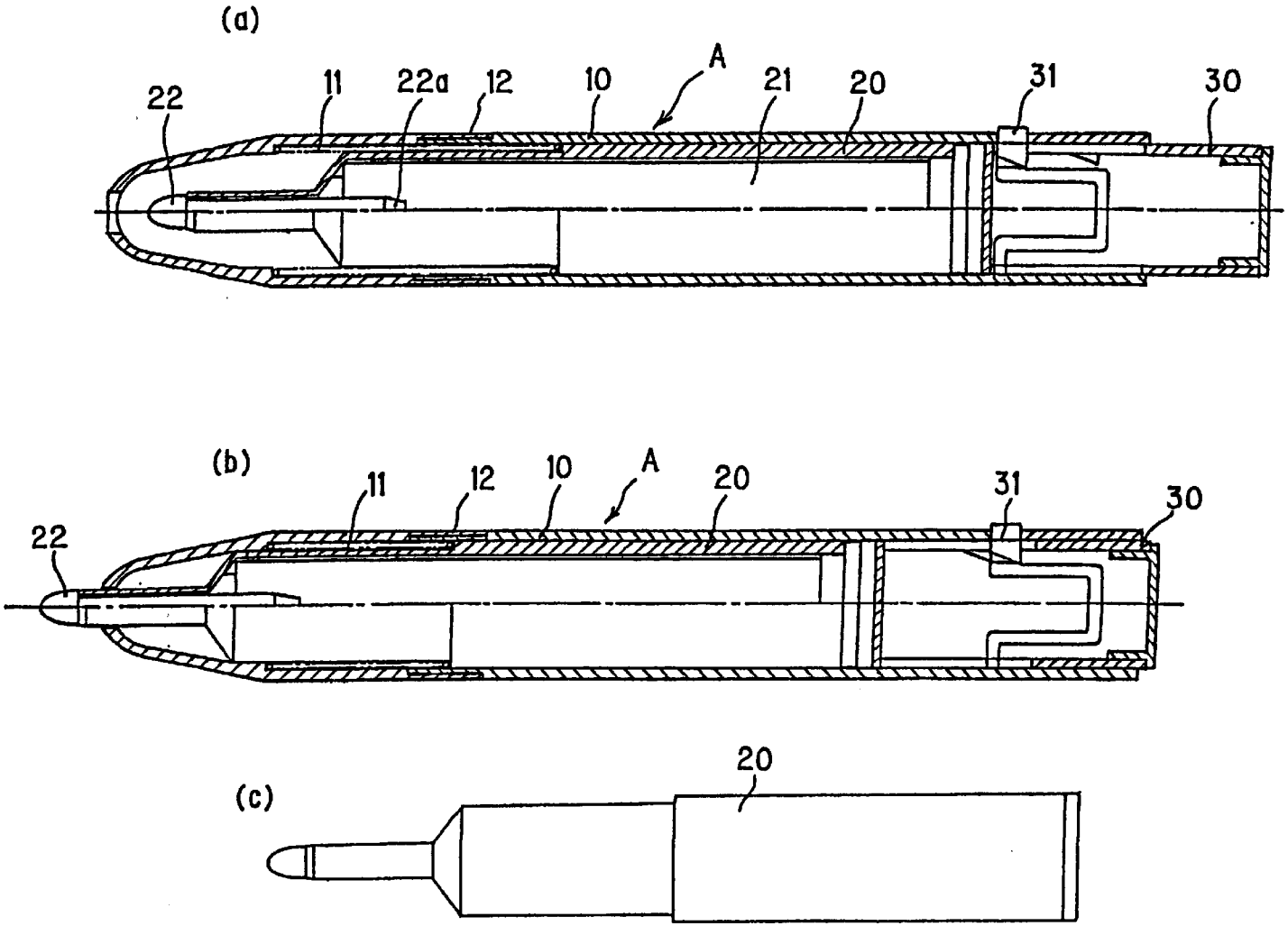
FIGS. 1(*a*) to (*c*) are explanatory drawings showing in a cross-sectional mode, one example in which the writing instrument of the present invention is applied to a knock type writing instrument.

The structure of the writing instrument of the present invention shall not specifically be restricted as long as it is equipped with an exchangeable inner pen filled with an ink comprising a specific solvent in a writing instrument main body which is a barrel part and the above inner pen has a pen tip comprising a fiber feeder or a plastic feeder, and given is, for example, a structure of a knock type writing instrument (a felt-tip pen, a marking pen and a writing brush pen) needing no cap member as shown in FIG. 1.

As shown in FIGS. 1(*a*) to (*c*), this writing instrument is a knock type writing instrument of a felt-tip pen type needing no cap member, in which an ink is occluded in an ink reservoir such as a sliver. The above writing instrument A is equipped with a synthetic resin-made (or metal-made) inner pen 20 of a refill type in a writing instrument main body 10 which is a barrel part. Taken is a constitution in which an ink reservoir 21 in which an ink component containing a solvent having a vapor pressure of 1 to 50 mm Hg (20° C.) is occluded in a fiber body such as a sliver is provided in this inner pen 20 and in which a rear end part 22*a* of a pen tip 22 comprising a fiber feeder is brought into contact with a front part of the above ink reservoir 21, whereby the ink contained in the ink reservoir 21 is fed to the pen tip 22. A part 30 is a knock part mounted to a rear end part of the main body 10, and provided is a structure in which the above knock part is pressed forward against an applied force of a resilient member 11 comprising a spring member, whereby the pen tip 22 protrudes from a tip aperture of the main body 10 to fall into a writing situation and in which the pen tip 22 is received into the main body 10 by virtue of a resilient force of the resilient member 11 by operating a release button 31. A part 12 in the drawing is a screw part for dividing the writing instrument main body 10, and employed is a structure in which the inner pen 20 can readily be exchanged by loosing a screw of this screw part 12.

In the present invention, a material, a structure and a production process for the pen tip comprising a fiber feeder or a plastic feeder installed to the inner pen shall not specifically be restricted, and given are, for example, pen tips comprising fiber feeders obtained by processing parallel fiber bundles comprising one of or a combination of two or more kinds of natural fiber, animal hair fiber, polyacetal base resins, acryl base resins, polyester base resins, polyamide base resins, polyurethane base resins, polyolefin base resins, polyvinyl base resins, polycarbonate base resins, polyether base resins and polyphenylene base resins and fiber bundles such as felt or by subjecting these fiber bundles to resin treatment, plastic feeders prepared by forming ink grooves along axis directions of the various plastic materials described above and porous matters obtained by fusing powder of the various plastic materials described above. The form thereof is optional and may be a plate, a fiber-converged matter, a sintered matter or a foamed matter.

Figure 2:
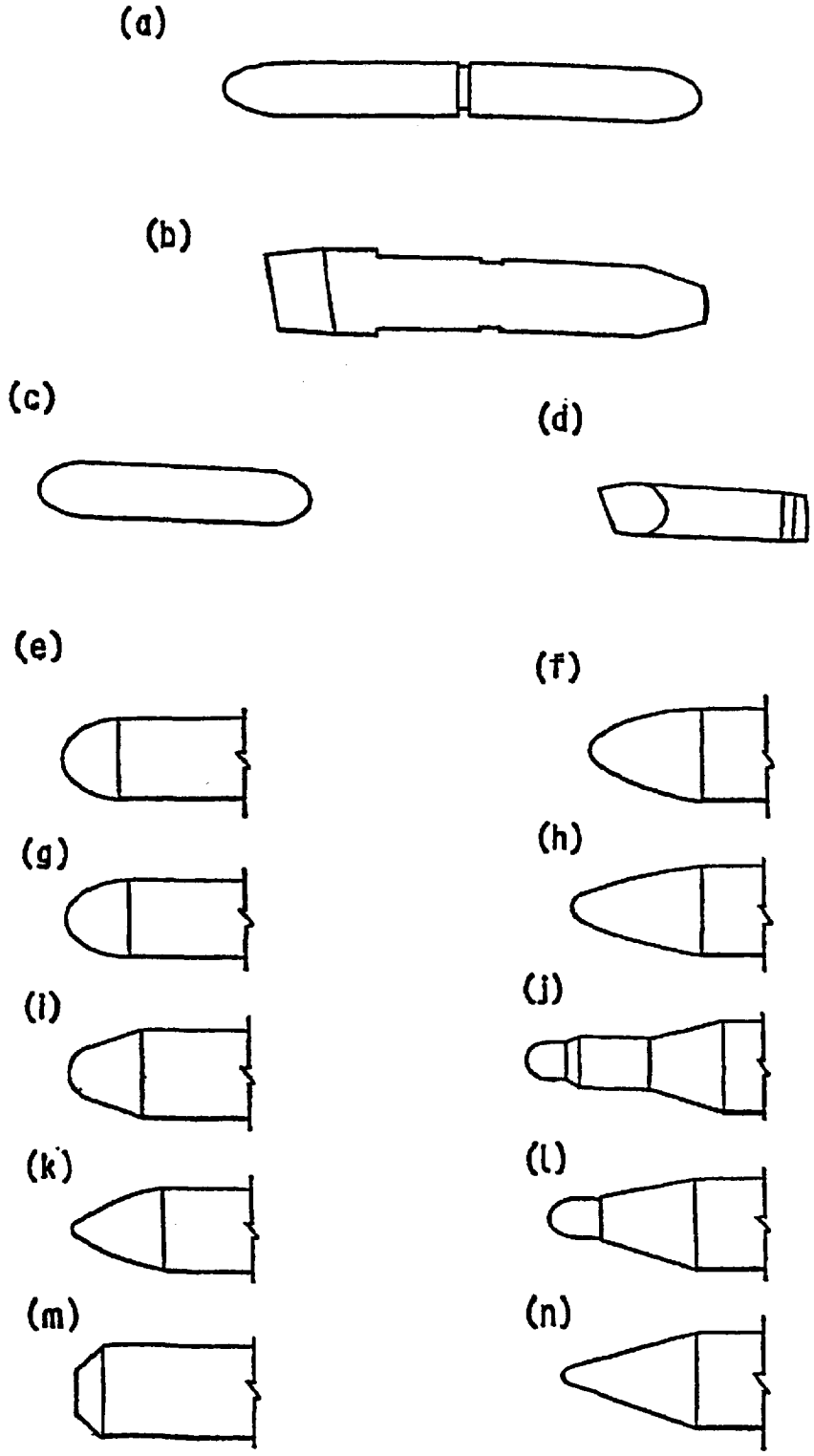
FIGS. 2(*a*) to (*n*) are explanatory drawings showing a structure of a pen tip comprising a fiber feeder used for the writing instrument of the present invention.

A specific form of the pen tip comprising a fiber feeder includes, for example, those shown in FIGS. 2(*a*) to (*n*). An embodiment of ink grooves of a pen tip comprising a plastic feeder shown in FIG. 3(*a*) in which ink grooves are formed in the axial directions of the various plastic materials described above includes, for example, those having patterns shown in FIGS. 3(*b*) to (*j*).

When a fiber feeder is used for the pen tip in order to obtain the intended writing instrument of a refill type having an excellent vaporization-inhibiting performance by coating these pen tips with a substance having a vaporization-inhibiting action, preferred are feeders having a porosity of 30 to 75% and a slit size of about 1 to 20 $\mu$m. When a plastic feeder is used for the pen tip, feeders having an average slit size of 20 to 40 $\mu$m are preferred.

The porosity and slit size described above shall not be restricted to the value ranges described above as long as the object of the present invention can be achieved by coating the pen tip with a substance having a vaporization-inhibiting action described later.

Further, the slit size described above is calculated from the following equation:

$$\text{slit size} = \text{porosity} \times \text{radius of yarn}/(1-\text{porosity})$$

The substance having a vaporization-inhibiting action used in the present invention shall not specifically be restricted as long as it is a substance providing the pen tip comprising a fiber feeder or a plastic feeder with a vaporization-inhibiting performance. It is preferably solid at room temperature (25° C., hereinafter the same shall apply) and has a solubility of 10% or less, preferably 5% or less and more preferably 1% or less in an ink solvent at room temperature, and a lower limit value of the solubility is preferably 0.01% or more and more preferably 0.1% or more.

Among the substances providing the pen tip with a vaporization-inhibiting performance, those which are liquid at room temperature or have a solubility exceeding 10% in an ink solvent at room temperature are eluted into an ink solvent by virtue of dissolution and diffusion action, and the effect thereof is reduced by storage over a long period of time or lost as an ink decreases while using the pen, so that the effects of the present invention can not be achieved.

The solubility of 10% or less in an ink solvent at room temperature means that the substance having a vaporization-inhibiting action has a solubility of 10% or less in an ink solvent used in the present invention (a solvent comprising an organic solvent which is an ink component described later) at room temperature.

More preferred substances having a vaporization-inhibiting action are those which have the characteristics described above and whose melting point (mp) is 40 to 95° C., preferably 50 to 85° C. and more preferably 60 to 75° C. among the substances providing the pen tip with a vaporization-inhibiting performance.

Use of the substances provided with a vaporization-inhibiting action having a melting point of 40 to 95° C. further improves the shelf life at a low temperature, makes it possible to exert better writing performance without causing clogging in the ink reservoir such as a sliver and the feed in the ink passage and shortens a drying time of drawn lines when drawn on a non-absorbing surface of glass and the like since the substance having a vaporization-inhibiting action is not eluted into the ink more than required.

The substance having a vaporization-inhibiting action used in the present invention has preferably the characteristics described above, that is, the characteristics that it is solid at room temperature and that it has a solubility of 10% or less in the ink solvent at room temperature, and it includes, for example, one or a mixture of two or more kinds selected from the group consisting of glycerin derivatives such as diglycerin monostearate, triglycerin monostearate, pentaglyceriyl tristearate, hexaglyceryl tristearate and decaglycerin distearate, alkyl phosphates such as polyoxyethylenestearyl phosphate, polyoxyethylenesorbitan fatty acid esters such as polyoxyethylenesorbitan monostearate and polyoxyethylenesorbitan tristearate, polyoxyethylenesorbit fatty acid esters such as polyoxyethylenesorbit hexastearate, paraffin waxes, microcrystalline waxes, lecithin, sucrose esters, polyolefin waxes, ascorbic acid stearyl ester and sorbitan acid stearyl ester.

Particularly preferred are diglycerin monostearate, pentaglyceryl tristearate, polyoxyethylenestearyl phosphate, lecithin, paraffin waxes, microcrystalline waxes and polyolefin waxes, because of the reasons that they have a melting point of 40 to 95° C. and a solubility of 10% or less in the solvent at room temperature and they are less liable to be released by physical friction of the pen tip caused by writing and flow-out of the ink and that durability and an effect are improved with the higher hardness and the lower solubility thereof.

In the present invention, a coating method of the substance providing the pen tip with a vaporization-inhibiting performance and having the characteristics described above shall not specifically be restricted as long as the pen tip comprising a fiber feeder or a plastic feeder is coated with it in an amount required for allowing the effects of the present invention to be exerted. It can be coated, for example, by dissolving the substance having the characteristics described above in a solvent, subjecting the pen tip to dipping treatment or spraying treatment with it and then drying the pen tip by heating or at room temperature. When the solubility is extremely low, the pen tip can be coated therewith by dipping in the heated solution and then cooling.

These coating methods are excellent as easy and inexpensive methods.

A solvent for dissolving the substance having the characteristics described above includes, for example, alcohols such as methyl alcohol, ethyl alcohol, n-propyl alcohol and isopropyl alcohol (i-propyl alcohol), glycols such as ethylene glycol monomethyl ether, ethylene glycol monoethyl ether and propylene glycol monomethyl ether, ketones such as acetone and methyl ethyl ketone, esters such as methyl acetate, ethyl acetate, butyl acetate, ethylene glycol monomethyl ether acetate and propylene glycol monoethyl ether acetate, ethers such as dimethyl ether and diethyl ether, hydrocarbons such as hexane, heptane and methylcyclohexane and chlorine compounds such as chloroform and methylene chloride.

An amount of the substance having the characteristics described above coated on the pen tip is 0.01 to 20% by weight, preferably 0.1 to 10% by weight and more preferably 0.3 to 5% by weight in terms of a weight ratio based on the pen tip.

If the coating amount is less than 0.01% by weight, the effects of the present invention can not be achieved. On the other hand, if it exceeds 20% by weight, a balance between an ink passage at the pen tip and strength (durability) of the pen tip is lost and the ink is less liable to be discharged, so that starving is caused and breakage of the pen tip is brought about as writing goes on. Accordingly, both ranges are not preferred.

The ink components filled into the inner pen in the present invention include a colorant, a solvent having a vapor pressure of 1 to 50 mm Hg (20° C.), a resin which is soluble in the above solvent and other additives for an ink for a writing instrument.

The colorant includes oil-soluble dyes and pigments, and almost all oil-soluble dyes can be used as the oil-soluble dyes as long as they are conventional oil-soluble dyes which are soluble in organic solvents.

The dyes include, for example, Orasol Yellow 2GLN, Orasol Red 3GL, Orasol Blue 2GLN, Neozapon Blue FLE, Spirit Black SP, Valifast Red 1308, Oil Blue BA, Oil Yellow 185, Oil Red TR71, Oil Black S, Victoria Blue, Rhodamine 6JHSA and Flex Yellow. The pigments shall not specifically be restricted and include, for example, organic pigments such as azo base pigments, condensed polyazo base pigments, phthalocyanine base pigments, metal complex salt base pigments, thioindigo pigments, dye lake pigments and fluorescent pigments and inorganic pigments such as carbon black and titanium oxide, and capable of being further used are processed pigments which are processed on surfaces by resin coating, for example, various microlith A types, AS Black, AS Blue and IK Red. These dyes and/or pigments can be used alone or in a mixture of two or more kinds thereof, and a use amount thereof is varied depending on the kind of the colorant and the other ink components, and it is 1 to 30% by weight, preferably 2 to 15% by weight based on the total ink amount.

A solvent having a vapor pressure of 1 to 50 mm Hg (20° C.) (hereinafter referred to as "vapor pressure range") has to be used as the solvent.

The usable solvents include, for example, lower alcohols falling in the vapor pressure range described above such as ethyl alcohol, propyl alcohol and isopropyl alcohol, aromatic hydrocarbons falling in the vapor pressure range described above such as toluene and xylene, lower aliphatic ketones falling in the vapor pressure range described above such as methyl ethyl ketone and methyl isobutyl ketone, lower alcohol esters of lower fatty acids falling in the vapor pressure range described above such as ethyl acetate and butyl acetate, aliphatic hydrocarbons falling in the vapor pressure range described above such as hexane and heptane, alicyclic hydrocarbons falling in the vapor pressure range described above such as cyclohexane and ethylcyclohexane and glycol ethers falling in the vapor pressure range described above such as alkyl ethers of glycols and propylene glycol monomethyl ether.

The solvents having these characteristics each can be used alone or in a mixture of two or more kinds thereof, and a use amount thereof is 50 to 90% by weight, preferably 70 to 85% by weight based on the total ink amount.

They include solvents having a vapor pressure of preferably 1 to 40 mm Hg (20° C.), more preferably 5 to 35 mm Hg (20° C.), to be specific, n-propyl alcohol, isopropyl alcohol, toluene, methyl isobutyl ketone, butyl acetate, ethylcyclohexane and propylene glycol monomethyl ether.

If the solvent has a vapor pressure of less than 1 mm Hg (20° C.), drying of the drawn lines is notably slow, and it is unsuited for a marker. On the other hand, if the solvent has a vapor pressure exceeding 50 mm Hg (20° C.), the solvent is liable to be volatilized, and therefore a sealing structure of the writing instrument has to be complicated, which results in coming expensive. Accordingly, both ranges are not preferred.

The resin is used as a film-forming agent, an adhesive to a coated face, a viscosity-controlling agent for an ink and a dispersant for a colorant, and various natural resins and synthetic resins which have so far been used can be used. They include, for example, rosin base resins such as rosin, ester gum, maleic acid-modified rosin and phenol-modified rosin, cellulose base resins such as ethyl cellulose and nitrocellulose, vinyl base resins such as polyvinylbutyral and vinyl chloride-vinyl acetate copolymers, petroleum base resins, ketone base resins, acryl base resins, condensation products of aldehyde and urea and maleic acid base resins. They can be used alone or in a mixture of two or more kinds thereof. A use amount thereof is 0.1 to 30% by weight, preferably 1 to 20% by weight based on the total ink amount.

The other additives for the writing instrument include, for example, anionic, nonionic and cationic surfactants, an antiseptic, a fungicide, a rust preventive, a lubricant, a pH-controlling agent, an erasing agent and a plasticizer.

In the writing instrument of the present invention thus constituted, the writing instrument main body is equipped with an inner pen of a refill type filled with an ink containing a solvent having a vapor pressure of 1 to 50 mm Hg (20° C.), and the pen tip comprising a fiber feeder or a plastic feeder mounted at the tip of the above inner pen is coated with the substance having a vaporization-inhibiting action described above, preferably the substance having a vaporization-inhibiting action which is solid at room temperature, more preferably the substance which has a melting point of 40 to 95° C. and a solubility of 10% or less in a solvent at room temperature, whereby a very fragile film can be formed on the surface of the pen tip. This film prevents the solvent, which is a volatile component contained in the ink, from vaporizing, and the above film is broken by writing force in writing, whereby writing becomes possible. In addition thereto, the substance having a vaporization-inhibiting action coated on the pen tip is eluted again, though varied depending on the coating amount described above, into the ink in a required amount, and when the pen tip is exposed to air next time, a new film is formed on the surface of the pen tip by interaction with the ink solvent. This cycle of film formation—writing—film formation—writing—is repeated to exhibit the effect many times. This effect is repeated until the ink component filled into the inner pen is exhausted.

In the present invention, the writing instrument is equipped with the exchangeable inner pen (refill) filled with an ink which has the pen tip comprising a fiber feeder or a plastic feeder, and it is excellent in inhibition of vaporization of an ink solvent from the pen tip, so that provided is the writing instrument in which the inner pen (refill) is less deteriorated, simple and exchangeable even if a sealing structure is insufficient and which is convenient, well adapts to environmental issues such as the best utilization of the resources and can achieve a reduction in the cost.

In particular, in a knock type writing instrument having no cap member shown in FIG. 1, a good writing performance can be achieved even if it has a structure in which the pen tip is not sealed. Further, the ink does not contain the substance needing a vaporization-inhibiting action, so that the shelf life at a low temperature is good, and clogging is not caused in the ink passage.

Further, in the writing instrument of the present invention prepared by coating the pen tip with the respective substances having a vaporization-inhibiting action described above which are solid at room temperature and have a melting point of 40 to 95° C. and whose solubility is 10% or less in the solvent at room temperature, the substance having a vaporization-inhibiting action is not eluted into the ink more than required, so that a drying time of lines drawn on a non-absorbing face of glass and the like is shorter.

More preferably in the present invention, not only the pen tip is coated with the substance having a vaporization-inhibiting action, but also the substance having the vaporization-inhibiting action of the characteristics described above is preferably added to the ink.

A substance having basically the same characteristics as those of the coating substance described above can be used as the substance having a vaporization-inhibiting action added to the ink.

An amount of the substance having the vaporization-inhibiting action of the characteristics described above added to the ink is 0.01 to 10% by weight in terms of a weight ratio based on the total ink amount.

If the amount added to the ink is less than 0.01% by weight, additional effects of the present invention can not be achieved. On the other, the addition amount exceeding 10% by weight results in that a drying time of the drawn lines becomes long and the intended effects are reduced with storage over a long period of time and that precipitations are produced in the ink by repeating of high and low temperatures to cause clogging in the ink passage to reduce the writing property.

If an amount of the substance having a vaporization-inhibiting action of the characteristics described above added to the ink is increased, a rate of causing a reduction in the writing performance goes up, and therefore it is preferably 0.05 to 5% by weight, more preferably 0.1 to 1% by weight based on the total ink amount.

In the writing instrument of this embodiment, the pen tip is coated with the substance having a vaporization-inhibiting action, and in addition thereto, the substance having a vaporization-inhibiting action is further added to the ink in an amount falling in a range where the ink components are not deteriorated, and therefore further excellent effects of the present invention can be exerted.

Particularly preferably, an amount of the substance having a vaporization-inhibiting action coated on the pen tip is set to 0.1 to 10% by weight in terms of a weight ratio based on the pen tip, and an amount of the above substance having a vaporization-inhibiting action added to the ink is set to 0.1 to 2% by weight based on the total ink amount, whereby further excellent effects of the present invention can be obtained (this point shall further be explained with reference to examples described later).

Figure 5:
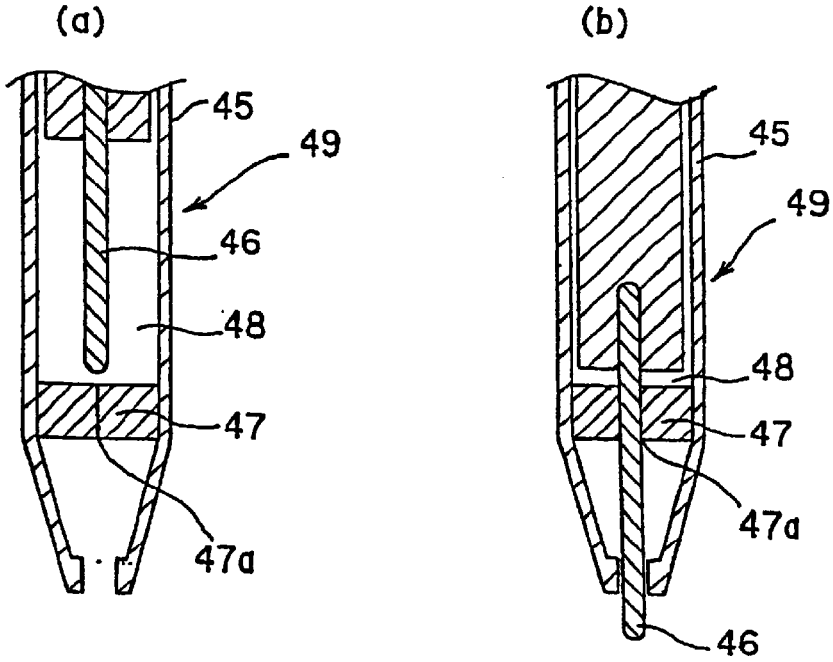
FIGS. 5(*a*) and (*b*) are explanatory drawings showing in a cross-sectional mode, another example of a writing instrument having a conventional dry-preventing mechanism for a pen tip.
Figure 6:
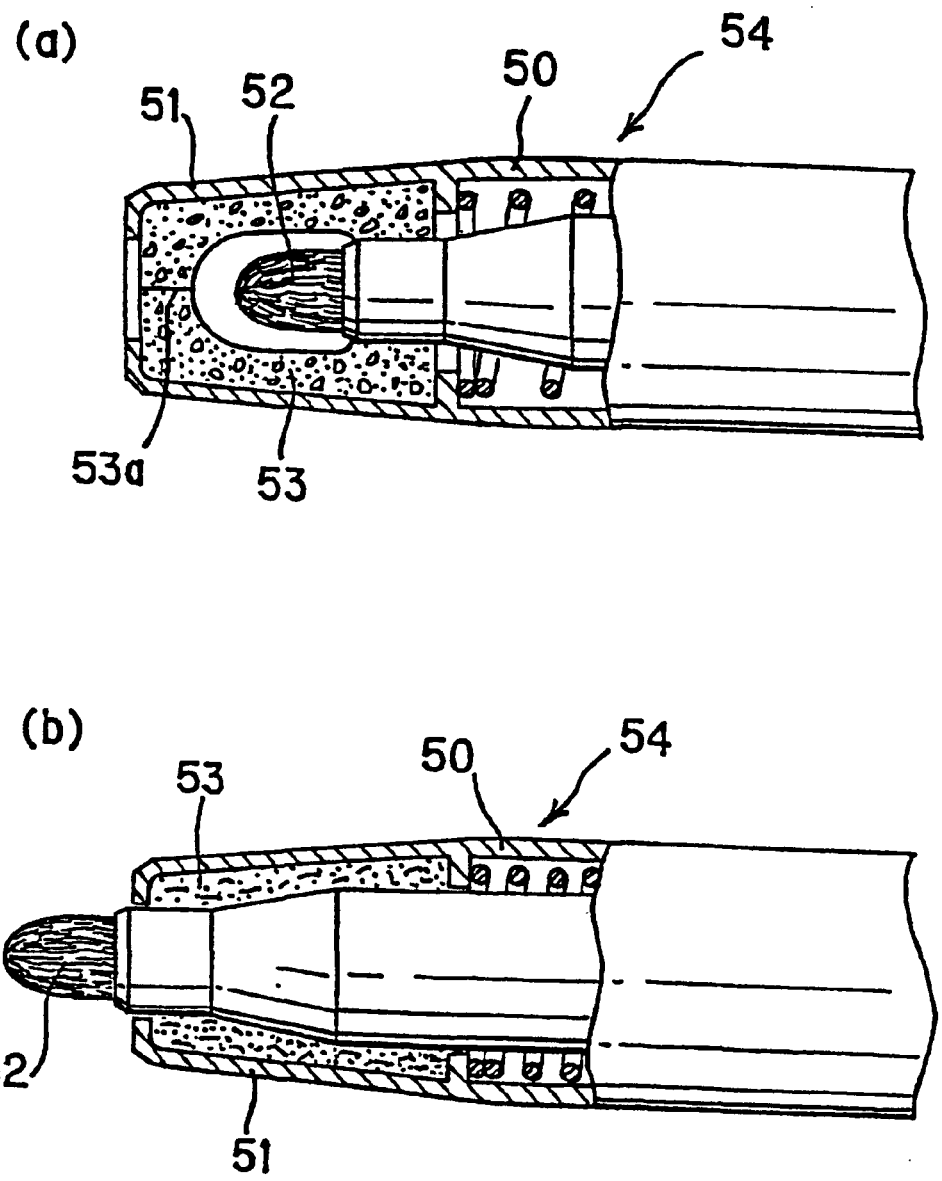
FIGS. 6(*a*) and (*b*) are explanatory drawings showing in a cross-sectional mode, still other example of a writing instrument having a conventional dry-preventing mechanism for a pen tip.

The structure of the present invention can usually be applied to writing instruments of uses such as marking pens, felt-tip pens and writing brush pens as long as they are writing instruments equipped with an exchangeable inner pen filled with an ink containing a solvent having a vapor pressure of 1 to 50 mm Hg (20° C.) in a writing instrument main body which is a barrel part. Further, it may be applied to the writing instrument having a simple sealing structure shown in FIG. 5 or FIG. 6. In particular, it can suitably be applied to the writing instrument of a knock type needing no cap member shown in FIG. 1.

It goes without saying that the writing instrument of the present invention shall not be restricted to the embodiments described above and that it can be modified to various embodiments as long as the gist the present invention is not changed.

In the writing instrument of the present invention, a inner pen in which the ink is occluded in a sliver is used in the embodiment described above, but it may be a inner pen having a pen tip equipped with a valve mechanism and comprising a fiber feeder or a plastic feeder or an inner pen which has a pen tip comprising a fiber feeder or a plastic feeder and directly stores an ink. Further, the writing instrument of the present invention shall not specifically be restricted as long as the pen tips comprising a fiber feeder or a plastic feeder in the inner pens are coated with the substance having the vaporization-inhibiting action of the characteristics described above, and the substance having a vaporization-inhibiting action is further added to the ink. Further, it can be applied to applicators for cosmetic and the like.

In particular, in the present invention, even if the pen tip is housed in the inside of the writing instrument main body without disposing a cap member, the writing instrument having a good writing performance can be achieved, and therefore the present invention can suitably be used for writing instruments such as a making pen a felt-tip pen and a writing brush pen which is of knock type and of refill type needing no cap member for a writing instrument.

EXAMPLES

Next, the present invention shall be explained in further details with reference to examples and comparative examples, but the present invention shall not be restricted to the examples described below.

Examples 1 to 14 and Comparative Examples 1 to 11

Knock type marking pens (ink amount: 4.5 g) equipped with a inner pen having a pen tip shown in FIG. 1 were used as writing instruments in Examples 1 to 14 and Comparative Examples 1 to 11. An aperture through which a pen tip 22 come out from a writing instrument main body 10 had an area of 0.3 $cm^2$.

The pen tip was a fiber feeder comprising a sliver of acryl fibers, and used was the feeder having a weight of 0.19 g, a length of 37 mm and a diameter of 4.0 mm (porosity: about 60%).

Used as a coating substance (agent) were (1) hexaglyceryl tristearate (melting point: 57° C.), (2) polyoxyethylenesorbitan monostearate (melting point: 53° C.), (3) polyoxyethylenestearyl phosphate (melting point: 56° C.), (4) microcrystalline wax (melting point: 67° C., "HI-Mic-2045" manufactured by Nippon Seiro Co., Ltd.) and (5) paraffin wax (melting point: 61° C., "Paraffin Wax 140" manufactured by Nippon Seiro Co., Ltd.).

The solubilities of (1) to (5) described above in an ink solvent [a solvent comprising n-propyl alcohol (vapor pressure: 14.5 mm Hg, 20° C.), i-propyl alcohol (vapor pressure: 32.4 mm Hg, 20° C.) and propylene glycol monomethyl ether (vapor pressure: 7.6 mm Hg, 20° C.)] were at room temperature (1) 0.4%, (2) 9%, (3) 0.1%, (4) 0.1% or less and (5) 0.1% or less, respectively.

In respect to a coating method, a prescribed amount of the coating substance was dissolved in methylene chloride, and the pen tip described above comprising a fiber feeder was dipped in the above preparation and heated at 50° C. for one hour. Then, it was left standing one night at room temperature to cool down, and it was thrown into a mesh-shaped vessel to remove the solvent. Next, the pen tip was dried at room temperature for one hour, then at 50° C. for 3 hours and further at room temperature for 3 hours, and it was used as a sample and was incorporated as shown in FIG. 1 to assemble a marking pen (ink amount: 4.5 g). This marking pen was used to carry out the following tests.

In respect to the coating amount, an amount of the coating agents of (1) to (5) described above coated on the pen tip was represented by a difference in a weight of the pen tip before and after treating and shown by weight % based on the weight of the pen tip before treating. The pen tips treated by the method described above at the treating rates of 1%, 2% and 3% were used in the examples.

Inks 1 to 10 comprising compositions shown in the following Table 1 were used.

Comparative Example 5

In respect to the pen tip and the marking pen which were the test members, the same ones as used in Examples 1 to 14 and Comparative Examples 1 to 11 were used.

Figure 3:
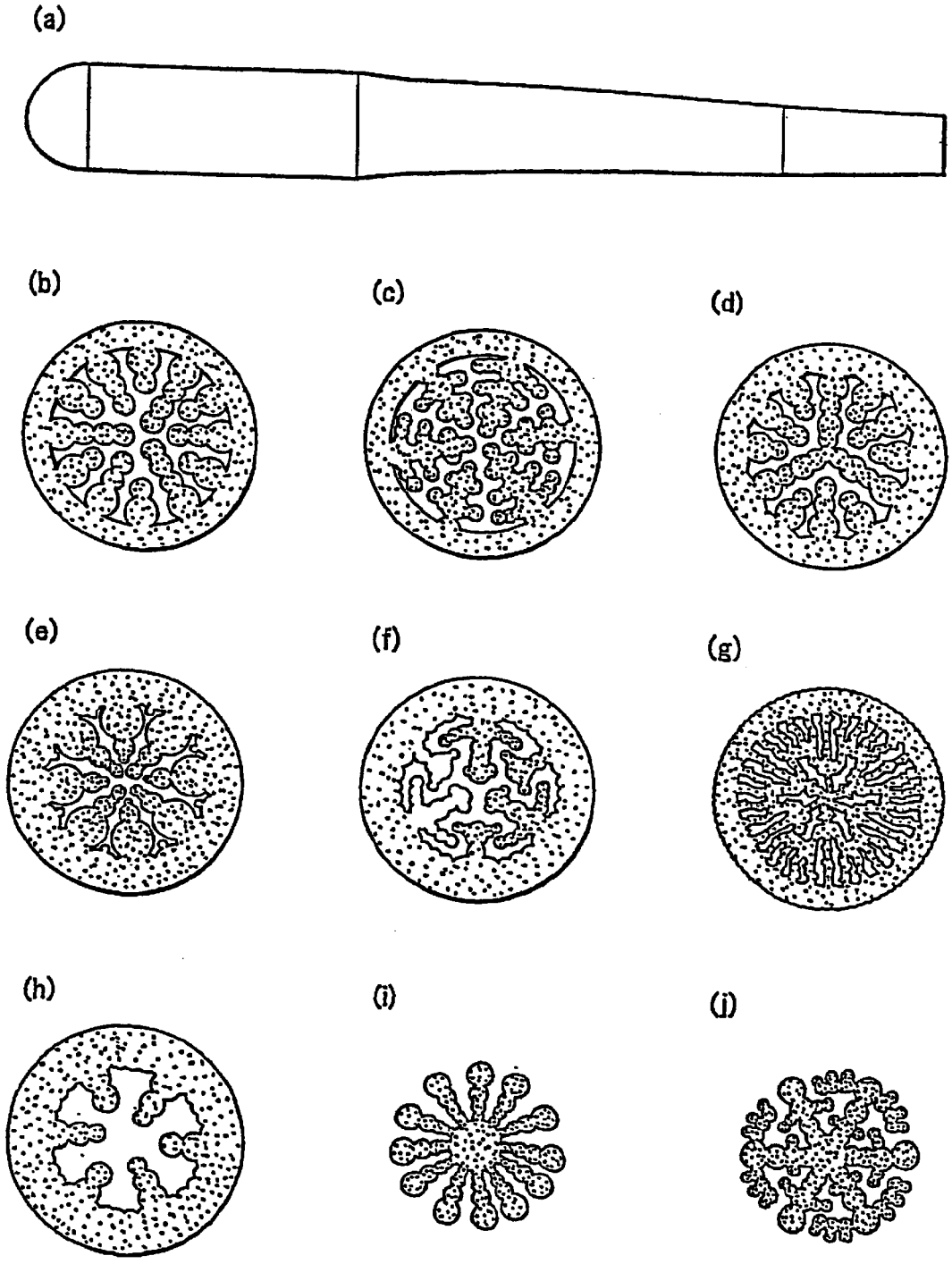
FIGS. 3(*a*) to (*j*) are explanatory drawings showing a structure of a pen tip comprising a plastic feeder used for the writing instrument of the present invention.
Figure 4:
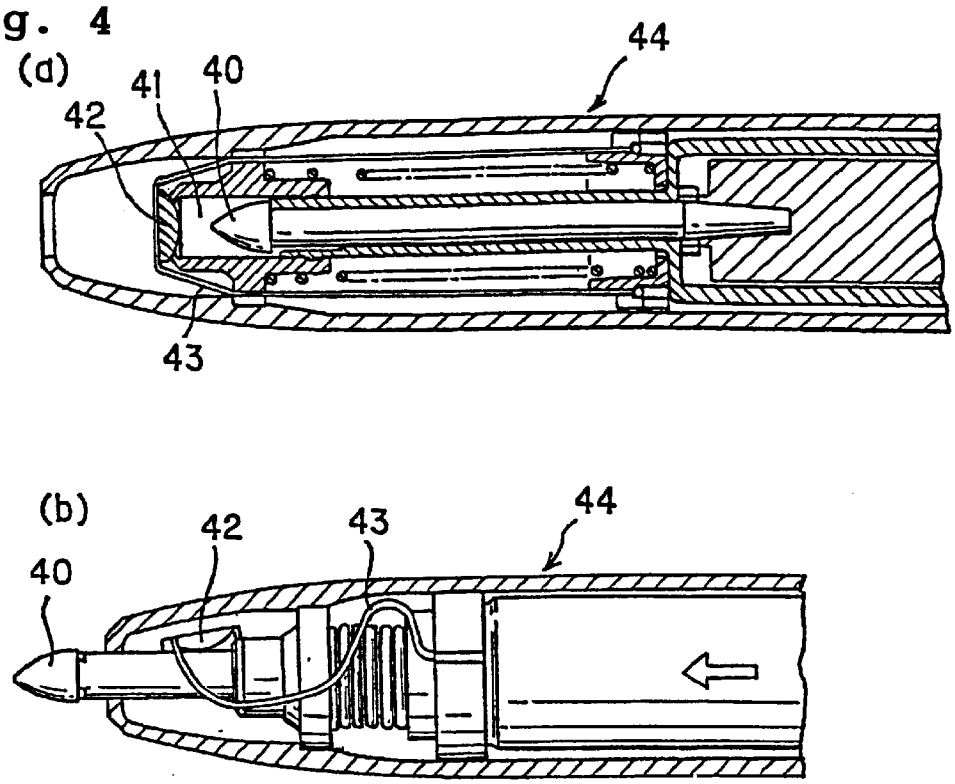
FIGS. 4(*a*) and (*b*) are explanatory drawings showing in a cross-sectional mode, one example of a writing instrument having a conventional dry-preventing mechanism for a pen tip.

In respect to treating of the pen tip, the pen tip described above comprising a fiber feeder was dipped in benzyl alcohol (melting point: −15.5° C.), and then a marking pen (ink amount: 4.5 g) into which the above pen tip was incorporated as shown in FIG. 3 was immediately assembled so that benzyl alcohol was not dried. The dipping amount was about 0.2 g, though varied because of scatter of drying of benzyl alcohol and variation in the shape of the pen tip. This assembled marking pen was left standing one day at room temperature and then used for carrying out the following tests.

TABLE 1

(Ink composition)

(blend unit: % by weight)

| Ink composition | (1) | (2) | (3) | (4) | (5) | (6) | (7) | (8) | (9) | (10) |
|---|---|---|---|---|---|---|---|---|---|---|
| n-Propyl alcohol | 75.0 | — | 74.0 | — | 74.0 | — | 74.6 | — | 73.6 | — |
| i-Propyl alcohol | 7.5 | — | 7.5 | — | 7.5 | — | 7.5 | — | 7.5 | — |
| Propylene glycol monomethyl ether | — | 84.0 | — | 82.0 | — | 82.0 | — | 83.8 | — | 82.8 |
| Laropearl A101*1 | — | 12.0 | — | 12.0 | — | 12.0 | — | 12.0 | — | 12.0 |
| Alresat KM400*2 | 10.0 | — | 10.0 | — | 10.0 | — | 10.0 | — | 10.0 | — |
| Victoria Blue BSA*3 | 2.5 | 3.0 | 2.5 | 3.0 | 2.5 | 3.0 | 2.5 | 3.0 | 2.5 | 3.0 |
| Rhodamine 6JHSA*4 | 2.5 | 1.0 | 2.5 | 1.0 | 2.5 | 1.0 | 2.5 | 1.0 | 2.5 | 1.0 |
| Flex Yellow 105*5 | 2.5 | — | 2.5 | — | 2.5 | — | 2.5 | — | 2.5 | — |
| Hexaglyceryl tristearate*6 | — | — | 1.0 | — | — | — | 0.4 | — | 0.4 | — |
| Polyoxyethylenesorbitan monostearate*7 | — | — | — | 2.0 | — | — | — | — | — | — |
| Polyoxyethylene stearate*8 | — | — | — | — | — | — | — | 0.2 | — | 0.2 |
| Microcrystalline wax*9 | — | — | — | — | 1.0 | — | — | — | 1.0 | — |
| Paraffin wax*10 | — | — | — | — | — | 2.0 | — | — | — | 1.0 |

*1condensation product of aldehyde and urea (manufactured by BASF Co., Ltd.)
*2maleic acid resin (manufactured by Hoechst Co., Ltd.)
*3dye (manufactured by Zeneca Co., Ltd.)
*4dye (manufactured by Zeneca Co., Ltd.)
*5dye (manufactured by Zeneca Co., Ltd.)
*6coating agent (1) (cap-off performance-providing ink additive)
*7coating agent (2) (cap-off performance-providing ink additive)
*8coating agent (3) (cap-off performance-providing ink additive)
*9coating agent (4) (cap-off performance-providing ink additive, [Hi-Mic-2045])
*10coating agent (5) (cap-off performance-providing ink additive, [Paraffin Wax 140])

The marking pens obtained in Examples 1 to 14 and Comparative Examples 1 to 11 were used to carry out evaluation of a writing performance, a test after storing at a low temperature, a test after writing, a test of a drawn line-drying property and total evaluation thereof by the following evaluation methods.

The results thereof are shown in Table 2 and Table 3 shown below.

Evaluation of Writing Performance

In each marking pen, a writing performance at 25° C. based on a change with the passage of time (3 days to 6 months) in a state where an inner pen was housed was measured according to the following evaluation criteria. When the evaluation was ⊙ even after 3 months or more, preferably 6 months or more passed, it shows that the marking pen is excellent in a writing performance in terms of the passage of time and has no problems for practical use.

Evaluation Criteria

◎: writable without causing starving

○: starving is slightly caused at the beginning of writing

Δ: starving is caused at the first line

▽: starving is caused at the second line

X: not writable

Writing Performance Test after Storing at a Low Temperature

Each marking pen was left standing at 0° C. for 24 hours and then slowly returned to room temperature in one day and then a writing performance based on a change with the passage of time was measured in the same manner as the writing performance evaluation method described above to compare with the evaluation results described above at 25° C. Evaluate was carried out according to the following evaluation criteria.

Evaluation Criteria

◎: the same as the writing performance at 25° C. before storing at a low temperature ○: writing performance is a little reduced as compared with the writing performance at 25° C. before storing at a low temperature X: writing performance is notably reduced as compared with the writing performance at 25° C. before storing at a low temperature Writing Performance Test after Writing Each marking pen was subjected to 100 m writing under an environment of 25° C., and then a writing performance based on a change with the passage of time was compared with the evaluation results described above at 25° C. in the same manner as the test described above. Evaluate was carried out according to the following evaluation criteria.

Evaluation Criteria

◎: the same as before writing (writing performance at 25° C.)

○: writing performance is a little reduced as compared with before writing (writing performance at 25° C.)

X: writing performance is notably reduced as compared with before writing (writing performance at 25° C.)

Test of Drawn Line-drying Property

Each marking pen was used for writing on glass (20×20×0.5 cm) under an environment of 25° C. to measure time passing until the drawn lines were completely dried by touching with a finger.

In the drawn line-drying property, 30 seconds or shorter is ranked as good (○), and 10 seconds or shorter is ranked as very good (◎). If the drying time exceeds 30 seconds, the drawn line-drying property is inferior (X).

Total Evaluation

Total evaluation of each marking pen was done according to the following evaluation criteria taking into consideration the results of the writing performance, the test after storing at a low temperature, the test after writing and the test of drawn line-drying property.

Total Evaluation Criteria

◎: all items are satisfied

○: test after writing is not a little satisfactory but the other items are satisfied Δ: writing performance and drawn line-drying property are satisfactory but the other items are not satisfactory X: writing performance and drawn line-drying property are not satisfactory

TABLE 2

(Cap-off performance evaluation results)

| | | | Writing performance evaluation | | | | | | | | |
|---|---|---|---|---|---|---|---|---|---|---|---|
| Example | Pen core kind | Ink kind in Table 1 | 3 days | 1 week | 2 weeks | 1 month | 2 months | 3 months | 4 months | 5 months | 6 months |
| 1 | A | Ink (1) | ◎ | ◎ | ◎ | ◎ | ◎ | ◎ | ▽ | X | X |
| 2 | B | Ink (1) | ◎ | ◎ | ◎ | ◎ | ◎ | ◎ | ▽ | X | X |
| 3 | C | Ink (1) | ◎ | ◎ | ◎ | ◎ | ◎ | ◎ | ▽ | X | X |
| 4 | D | Ink (1) | ◎ | ◎ | ◎ | ◎ | ◎ | ◎ | Δ | ▽ | X |
| 5 | E | Ink (2) | ◎ | ◎ | ◎ | ◎ | ◎ | ◎ | ◎ | ◎ | ○ |
| 6 | F | Ink (1) | ◎ | ◎ | ◎ | ◎ | ◎ | ◎ | ▽ | X | X |
| 7 | G | Ink (1) | ◎ | ◎ | ◎ | ◎ | ◎ | ◎ | ▽ | X | X |
| 8 | H | Ink (1) | ◎ | ◎ | ◎ | ◎ | ◎ | ◎ | ▽ | X | X |
| 9 | I | Ink (2) | ◎ | ◎ | ◎ | ◎ | ◎ | ◎ | ◎ | ◎ | ◎ |
| 10 | G | Ink (7) | ◎ | ◎ | ◎ | ◎ | ◎ | ◎ | Δ | ▽ | X |
| 11 | H | Ink (7) | ◎ | ◎ | ◎ | ◎ | ◎ | ◎ | Δ | ▽ | X |
| 12 | I | Ink (7) | ◎ | ◎ | ◎ | ◎ | ◎ | ◎ | Δ | ▽ | X |
| 13 | G | Ink (8) | ◎ | ◎ | ◎ | ◎ | ◎ | ◎ | ◎ | ◎ | ◎ |
| 14 | H | Ink (8) | ◎ | ◎ | ◎ | ◎ | ◎ | ◎ | ◎ | ◎ | ◎ |

| Example | Writing test after storing at low temperature | Writing test after writing | Drawn line-drying property | Total evaluation |
|---|---|---|---|---|
| 1 | ◎ | ○ | 5 seconds | ○ |
| 2 | ◎ | ○ | 5 seconds | ○ |
| 3 | ◎ | ○ | 5 seconds | ○ |
| 4 | ◎ | ○ | 5 seconds | ○ |
| 5 | ◎ | ○ | 10 seconds | ○ |
| 6 | ◎ | ○ | 5 seconds | ○ |
| 7 | ◎ | ○ | 5 seconds | ○ |
| 8 | ◎ | ○ | 5 seconds | ○ |
| 9 | ◎ | ○ | 10 seconds | ○ |
| 10 | ◎ | ◎ | 5 seconds | ◎ |
| 11 | ◎ | ◎ | 5 seconds | ◎ |

TABLE 2-continued

| (Cap-off performance evaluation results) | | | | |
|---|---|---|---|---|
| 12 | ◎ | ◎ | 5 seconds | ◎ |
| 13 | ◎ | ◎ | 10 seconds | ◎ |
| 14 | ◎ | ◎ | 10 seconds | ◎ |

Pen core kind:
A: coating agent (1), treating rate 1% fiber core
B: coating agent (1), treating rate 2% fiber core
C: coating agent (1), treating rate 3% fiber core
D: coating agent (2), treating rate 1% fiber core
E: coating agent (3), treating rate 1% fiber core
F: coating agent (4), treating rate 1% fiber core
G: coating agent (4), treating rate 2% fiber core
H: coating agent (4), treating rate 3% fiber core
I: coating agent (5), treating rate 2% fiber core

TABLE 3

(Cap-off performance evaluation results)

| | | | Writing performance evaluation | | | | | | | | |
|---|---|---|---|---|---|---|---|---|---|---|---|
| Comparative Example | Pen core kind | Ink kind in Table 1 | 3 days | 1 week | 2 weeks | 1 month | 2 months | 3 months | 4 months | 5 months | 6 months |
| 1 | a | Ink (1) | ○ | X | | | | | | | |
| 2 | a | Ink (3) | ○ | ○ | ○ | ○ | ○ | Δ | X | | |
| 3 | a | Ink (2) | ○ | ▽ | X | X | | | | | |
| 4 | a | Ink (4) | ◎ | ◎ | ○ | ○ | ○ | ○ | Δ | X | X |
| 5 | b | Ink (2) | ○ | Δ | X | X | | | | | |
| 6 | a | Ink (5) | ○ | ○ | ○ | Δ | X | X | | | |
| 7 | a | Ink (6) | ◎ | ◎ | ◎ | ◎ | ◎ | ◎ | Δ | X | X |
| 8 | a | Ink (7) | ◎ | ◎ | ◎ | ○ | ○ | Δ | X | | |
| 9 | a | Ink (8) | ◎ | ◎ | ◎ | ◎ | ◎ | Δ | X | X | X |
| 10 | a | Ink (9) | ◎ | ◎ | ◎ | ◎ | Δ | X | X | | |
| 11 | a | Ink (10) | ◎ | ◎ | ◎ | ◎ | ◎ | ◎ | ◎ | ◎ | ◎ |

| Comparative Example | Writing test after storing at low temperature | Writing test after writing | Drawn line-drying property | Total evaluation |
|---|---|---|---|---|
| 1 | ○ | X | 5 seconds | X |
| 2 | X | X | 5 seconds | X |
| 3 | ○ | X | 5 seconds | X |
| 4 | X | X | 2 minutes or more | X |
| 5 | ○ | X | 2 minutes or more | X |
| 6 | X | X | 10 seconds | X |
| 7 | X | X | 10 seconds | Δ |
| 8 | X | X | 5 seconds | Δ |
| 9 | X | X | 2 minutes or more | X |
| 10 | X | X | 5 seconds | Δ |
| 11 | X | X | 10 seconds | Δ |

Pen core kind:
a: not treated
b: high boiling solvent (benzyl alcohol) dipping treatment, fiber core As apparent from the results in Table 2 and Table 3, it has been found that the marking pens obtained in Examples 1 to 14 according to the present invention in which the pen tips in the inner pens of a refill type are coated with the substance having a vaporization-inhibiting action have a good writing performance even if the pen tip is housed in the writing instrument main body having no cap member over a long period of time as compared with those of the marking pens prepared in Comparative Examples 1 to 11 falling outside of the scope of the present invention in which the pen tips are not coated with the substance having a vaporization-inhibiting action and that the test after storing at a low temperature shows good results as well.

To specifically observe the examples, obtained in Examples 1 to 9 are the marking pens in which the pen tips are coated with the substances having a vaporization-inhibiting action having different melting points, and obtained in Examples 10 to 14 are the writing instruments which are prepared by coating the pen tip with the substances having a vaporization-inhibiting action and in which the substances having a vaporization-inhibiting action are added to inks.

In particular, it has been found that in the writing instruments obtained in Examples 13 and 14 in which the pen tips are coated with the substances having a vaporization-inhibiting action and in which the substances having a vaporization-inhibiting action are added to inks, further better writing performance can be achieved even if the pen tip is housed in the writing instrument main body over further longer period of time as compared with Examples 1 to 12.

In contrast with this, to observe Comparative Examples 1 to 11, the pen tips are not coated with the substances having a vaporization-inhibiting action, and conventional ink components are used in Comparative Examples 1 and 3. It has been found that in these cases, all of the writing performances and the performances in the tests after storing at a low temperature and writing are declined.

Further, in Comparative Examples 2 and 4 and Comparative Examples 6 to 11, the pen tips are not coated with the substances having a vaporization-inhibiting action, and the substances having a vaporization-inhibiting action are dissolved in inks. It has been found that the writing performance is a little improved as compared with Comparative Examples 1 and 3, but both of the performances in the tests after storing at a low temperature and writing are declined and that the drawn line-drying property is deteriorated as well in Comparative Example 4 or 9.

Further, in Comparative Example 5, used is the pen tip subjected to conventional dipping treatment with a high boiling solvent (benzyl alcohol), and it has been found that also in this case, the writing (cap-off) performance is not good and that the performances after storing at a low temperature and writing are declined and the drawn line-drying property is deteriorated as well.

INDUSTRIAL APPLICABILITY

According to the present invention, provided is a writing instrument equipped with a pen tip comprising a fiber feeder or a plastic feeder and an exchangeable inner pen (refill) filled with an ink, wherein it is excellent in inhibition of vaporization of an ink solvent from a pen tip, and an inner pen (refill) is less deteriorated and exchangeable. It can suitably be applied to marking pens, felt-tip pens and writing brush pens having a structure in which a writing instrument main body is insufficient for inhibiting vaporization of an ink solvent, particularly does not need a cap member.

What is claimed is:

1. A writing instrument equipped with an exchangeable inner pen filled with an ink containing a solvent having a vapor pressure of 1 to 50 mm Hg (20° C.) in a writing instrument main body which is a barrel part, wherein the inner pen has a pen tip comprising a fiber feeder or a plastic feeder, and the pen tip is coated with a substance having a vaporization-inhibiting action, which forms a film that is always regenerated and broken in writing.

2. The writing instrument as described in claim 1, wherein the ink further comprises a substance having a vaporization-inhibiting action.

3. The writing instrument as described in claim 2, wherein the substance having a vaporization-inhibiting action is solid at room temperature and has a solubility of 10% by weight or less in an organic solvent at room temperature.

4. The writing instrument as described in claim 3, wherein the substance having a vaporization-inhibiting action has a melting point of 40 to 95° C.

5. The writing instrument as described in claim 4, wherein the writing instrument comprises a knock type writing instrument needing no cap member, and operation of a knock part allows the pen tip comprising a fiber feeder or a plastic feeder in the inner pen to go forward from and backward into the writing instrument main body.

6. The writing instrument as described in claim 3, wherein the substance having a vaporization-inhibiting action is at least one selected from the group consisting of glycerin derivatives, alkyl phosphates, polyoxyethylenesorbitan fatty acid esters, polyoxyethylenesorbit fatty acid esters, paraffin waxes, microcrystalline waxes, polyolefin waxes and lecithin.

7. The writing instrument as described in claim 6, wherein the writing instrument comprises a knock type writing instrument needing no cap member, and operation of a knock part allows the pen tip comprising a fiber feeder or a plastic feeder in the inner pen to go forward from and backward into the writing instrument main body.

8. The writing instrument as described in claim 3, wherein the writing instrument comprises a knock type writing instrument needing no cap member, and operation of a knock part allows the pen tip comprising a fiber feeder or a plastic feeder in the inner pen to go forward from and backward into the writing instrument main body.

9. The writing instrument as described in of claim 2, wherein a content of the substance having a vaporization-inhibiting action is 0.01 to 10% by weight based on the total ink amount.

10. The writing instrument as described in claim 9, wherein the writing instrument comprises a knock type writing instrument needing no cap member, and operation of a knock part allows the pen tip comprising a fiber feeder or a plastic feeder in the inner pen to go forward from and backward into the writing instrument main body.

11. The writing instrument as described in claim 2, wherein the writing instrument comprises a knock type writing instrument needing no cap member, and operation of a knock part allows the pen tip comprising a fiber feeder or a plastic feeder in the inner pen to go forward from and backward into the writing instrument main body.

12. The writing instrument as described in claim 1, wherein the substance having a vaporization-inhibiting action is solid at room temperature and has a solubility of 10% by weight or less in an organic solvent at room temperature.

13. The writing instrument as described in claim 12, wherein the substance having a vaporization-inhibiting action has a melting point of 40 to 95° C.

14. The writing instrument as described in claim 13, wherein the writing instrument comprises a knock type writing instrument needing no cap member, and operation of a knock part allows the pen tip comprising a fiber feeder or a plastic feeder in the inner pen to go forward from and backward into the writing instrument main body.

15. The writing instrument as described in claim 12, wherein the substance having a vaporization-inhibiting action is at least one selected from the group consisting of glycerin derivatives, alkyl phosphates, polyoxyethylenesorbitan fatty acid esters, polyoxyethylenesorbitan fatty acid esters, paraffin waxes, microcrystalline waxes, polyolefin waxes and lecithin.

16. The writing instrument as described in claim 15, wherein the writing instrument comprises a knock type writing instrument needing no cap member, and operation of a knock part allows the pen tip comprising a fiber feeder or a plastic feeder in the inner pen to go forward from and backward into the writing instrument main body.

17. The writing instrument as described in claim 12, wherein the writing instrument comprises a knock type writing instrument needing no cap member, and operation of a knock part allows the pen tip comprising a fiber feeder or a plastic feeder in the inner pen to go forward from and backward into the writing instrument main body.

18. The writing instrument as described in claim 1, wherein a coating amount of the substance having a vaporization-inhibiting action is 0.01 to 20% by weight in terms of a weight ratio based on the pen tip.

19. The writing instrument as described in claim 18, wherein the writing instrument comprises a knock type writing instrument needing no cap member, and operation of a knock part allows the pen tip comprising a fiber feeder or a plastic feeder in the inner pen to go forward from and backward into the writing instrument main body.

20. The writing instrument as described in claim 1, wherein the writing instrument comprises a knock type writing instrument needing no cap member, and operation of a knock part allows the pen tip comprising a fiber feeder or a plastic feeder in the inner pen to go forward from and backward into the writing instrument main body.

* * * * *